US006705411B2

(12) United States Patent
Looijen et al.

(10) Patent No.: US 6,705,411 B2
(45) Date of Patent: Mar. 16, 2004

(54) DOWNHOLE CORING DEVICE

(75) Inventors: Peter Nicolaas Looijen, Leidschendam (NL); Herman Maria Zuidberg, Rijnsburg (NL)

(73) Assignee: Fugro Engineers B.V., Leidschendam (NL)

( * ) Notice: Subject to any disclaimer, the term of this patent is extended or adjusted under 35 U.S.C. 154(b) by 0 days.

(21) Appl. No.: 10/233,089

(22) Filed: Aug. 28, 2002

(65) Prior Publication Data

US 2003/0066688 A1 Apr. 10, 2003

Related U.S. Application Data

(63) Continuation of application No. PCT/NL01/00706, filed on Sep. 25, 2001.

(30) Foreign Application Priority Data

Nov. 3, 2000 (NL) ..... 1016545

(51) Int. Cl.[7] ..... E21B 7/22; E21B 49/00; E21B 4/00

(52) U.S. Cl. ..... 175/6; 20/58; 20/107

(58) Field of Search ..... 175/20, 58, 107, 175/6, 246, 247

(56) References Cited

U.S. PATENT DOCUMENTS

| | | | | |
|---|---|---|---|---|
| 3,112,801 A | | 12/1963 | Clark et al. | |
| 3,583,502 A | * | 6/1971 | Henderson | 175/107 |
| 3,603,407 A | * | 9/1971 | Clark | 175/6 |
| 3,894,818 A | * | 7/1975 | Tschirky | 418/48 |
| 4,518,050 A | * | 5/1985 | Sollie et al. | 175/250 |
| 4,679,636 A | * | 7/1987 | Ruhle | 175/58 |
| 4,969,528 A | * | 11/1990 | Jurgens | 175/58 |
| 5,029,653 A | * | 7/1991 | Jurgens et al. | 175/58 |
| 5,038,873 A | | 8/1991 | Jurgens | |
| 5,052,502 A | * | 10/1991 | Jurgens et al. | 175/80 |

FOREIGN PATENT DOCUMENTS

WO WO99/09294 A1 2/1999

* cited by examiner

*Primary Examiner*—Thomas B. Will
*Assistant Examiner*—Thomas A. Beach
(74) *Attorney, Agent, or Firm*—Jeffrey D. Myers

(57) ABSTRACT

The invention relates to a downhole rotary coring device placeable in a drill string and comprising a head section, a motor, and a core barrel having an outer motor comprising a rotor connected to the outer barrel and a stator to the head section, whereby the rotor and the stator are movable with respect to each other in the longitudinal direction of the drill string.

19 Claims, 6 Drawing Sheets

SECTION C-C

DOWNHOLE CORING DEVICE

The invention relates primarily to a downhole rotary coring device placeable in a drill string and comprising a head section, a motor, and a core barrel having an outer barrel connected to the motor and an inner barrel placed inside the outer barrel.

Such a rotary coring device is used to obtain a sample of an earth formation.

Known designs use a series of tubes, referred to as drill string, to drill a hole into the formation. The lower end of the drill string is provided with a cutting mechanism, referred to as drill bit, which has a vertical, central hole. When a sample of the formation is required, the drilling is stopped and a coring device incorporating a motor is lowered inside the drill string and secured at the bottom end. By pumping fluid down the drill string, the motor is activated and the coring process is effected.

Rotary coring devices consist of an outer barrel with a coring bit at the lower end, which upon rotation cut an annular hole into the formation. The resulting pillar of rock is entering an inner tube. At the end of the coring process the outer and inner barrel assembly is lifted to break the pillar from the formation and to hoist it to the surface.

In a first aspect of the invention, the motor of the coring device comprises a rotor connected to the outer barrel and a stator connected to the head section, whereby the rotor and the stator are movable with respect to each other in the longitudinal direction of the drill string. In this way, both a rotational movement and a longitudinal movement with respect to the drill string can be performed ensuring an elegant manner for providing the required thrust while saving on space that would otherwise be required for a separate thruster.

A particularly useful manner for implementing such a motor is to select the motor to be of the helical screw type comprising a housing and a helically shaped axis positioned in the housing, whereby said axis is movable longitudinally with respect to the housing.

There are several embodiments feasible for the construction of the rotary coring device that is provided with a motor of the helical screw type each having their own function, advantage and benefit. Said embodiments will be discussed hereinafter with reference to FIG. 6.

Preferably, the downhole rotary coring device according to the invention is characterized in that a rotary bearing connects the inner barrel to the outer barrel, and that the inner barrel is slidably connected to a rod that is fixed to the head section, which rod cooperates with a passage in the inner barrel, whereby the said rod and passage are shaped so as to prevent said inner barrel to rotate. This effectively protects the core that is progressively being cut.

In a further aspect of the invention, on top of the core barrel a chamber is provided for receiving the inner barrel, which chamber is closable with a valve. This offers the advantage that the sample that has been received in the inner barrel, can be secured and safely separated in said chamber from the surroundings.

Again to save on space, it is preferred that in the fully open position the valve is positioned behind a protective sleeve that is in an initial position. The valve need not occupy much place, particularly in the embodiment in which the valve is a curved plate with a circumferential seal. The curvature of the plate then corresponds to the curvature of the barrel and the protective sleeve between which the plate is positioned in the fully open position.

The valve can be reliably operated when the sleeve is provided with lifting balls, and that the inner barrel has an outwardly extending rim suited to cooperate with said balls for lifting the sleeve when the inner barrel is moved into the chamber. When the sleeve is lifted far enough, the valve is no longer prevented from closing, and moves from its open position adjacent to the barrel's wall, i.e vertically, to a closed horizontal position. This movement from the vertical to the horizontal position can effectively be supported by spring action.

It is further desirable that the chamber is provided with a groove for receiving the lifting balls once the sleeve is placed in a lifted position so as to allow the inner barrel to continue its lifting motion whilst releasing the sleeve to return to its initial position.

In still a further aspect of the invention, the lifting of the inner barrel is supported by providing the rod with a piston that is positioned within the inner barrel, and that adjacent to the piston the rod is having a groove portion for receipt of rotary bearing balls forming part of the rotary bearing connecting the inner barrel to the outer barrel. This construction facilitates that once a complete sample is received in the inner barrel, the piston is located at the uppermost position within the inner barrel, such that the rotary bearing balls of the rotary bearing connecting the inner barrel to the outer barrel are free to leave their connecting position. This allows the inner barrel to move longitudinally with respect to the outer barrel, so that the inner barrel can eventually reach the earlier mentioned chamber in which the sample can be safely secured.

The invention further relates to a rotary coring system comprising a drill string and a downhole rotary coring device as mentioned hereabove, whereby the drill string is suspended from a vessel floating on sea. Such system is intended to take samples from positions below sea level.

The problem in such system is the necessity to make use of vessels floating on the sea, which will consequently move up and down together with the tide and the waves. This may adversely affect the quality of the sample being taken, and in order to prevent these adverse consequences, the rotary coring system according to the invention is characterized in that a frame is positioned and fixed on the sea bed, which is provided with a pipe clamp for the drill string. In this manner, the drill string can be effectively maintained at a steady vertical position without movement up and down due to movements of the vessel from which the drill string is suspended. The drill string can be effectively secured in this manner by having the frame fixed by gravity forces.

It is preferred that the pipe clamp is actuable by hydraulic jacks that are mounted on the frame, and a further preferred embodiment is characterized in that the pipe clamp has rotatable clamping blocks that are movable to and fro the drill string. This allows the drill string to be rotated whilst its vertical position is maintained at the same level.

In some circumstances it is desirable to avail of the possibility to move the drill string intentionally up and down. To that end, it is preferred that the frame has a vertical jacking system for moving the pipe clamp vertically.

The invention and its aspects shall now be further elucidated with reference to the drawing showing non-limiting embodiments of the system and downhole rotary coring device according to the invention.

Figure 1:
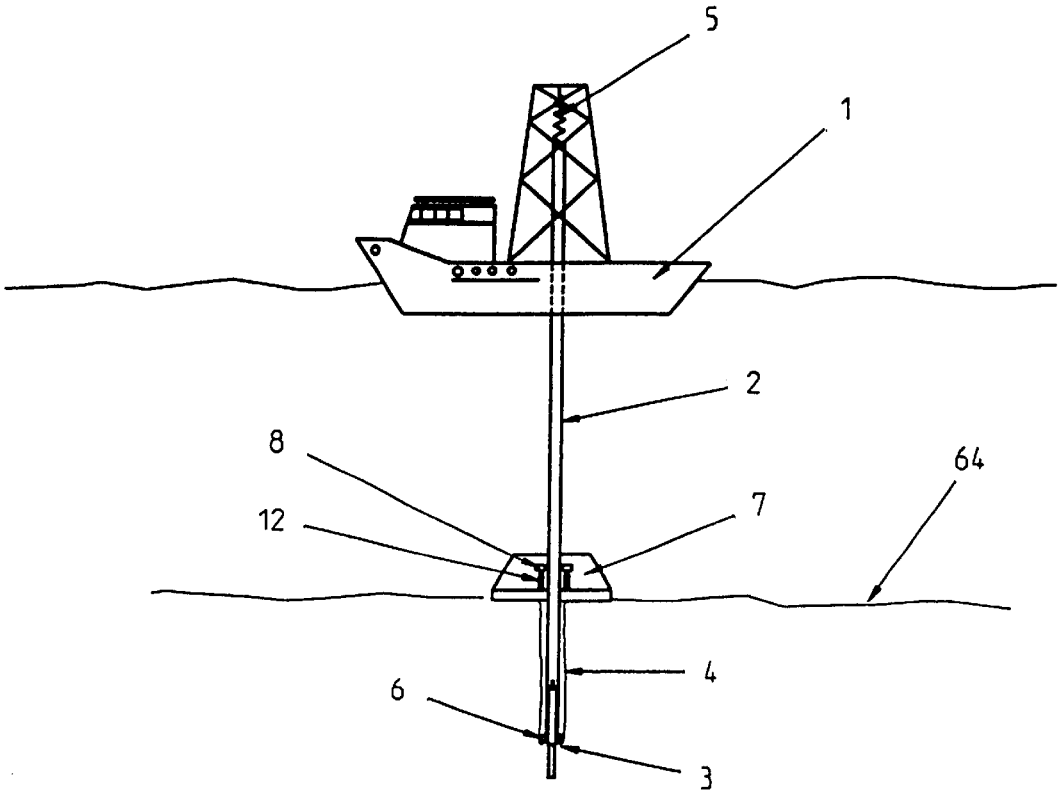
FIG. 1 shows a schematic diagram of the offshore rotary coring system.

FIG. 1 shows a system to perform drilling of boreholes at sea. Drilling is performed from a vessel 1 which moves up and down due to action of the waves. A drill string 2 is standing on the bottom 3 of the hole drilled 4 and is tensioned at the top by hoisting gear on the vessel incorporating a constant tension device 5 referred to as heave compensator.

In practice the tension exerted by the heave compensator is not constant and as a result the force exerted by the drill bit 6 on the sediments below the bottom of the hole is varying. When drilling in soft or friable formations, the force exerted by the drill bit frequently exceeds the bearing capacity of the formation. As a result, the position of the drill bit is not stable. In case tools, lowered down the drill string, are operated downhole to take samples from the bottom of the hole, the sampling process is endangered by the potential lack of stability of the drill bit and the quality of the sample is negatively affected.

The invention provides a system to stabilise the drill string by clamping it at the level of the seabed during those downhole operations that require a vertically stabilised drill bit. For this purpose with known means a frame 7 is placed at the seabed. A pipe clamp 8 is rigidly connected to the frame. The clamp is activated prior to the downhole operation represented in FIG. 2 by hydraulic jacks 11 and deactivated again afterwards to allow further drilling.

Figure 2:
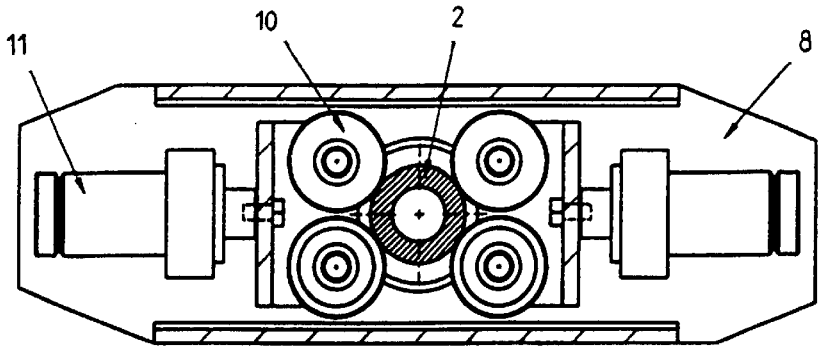
FIG. 2 shows a seabed mounted stabilisation system.
Figure 2:
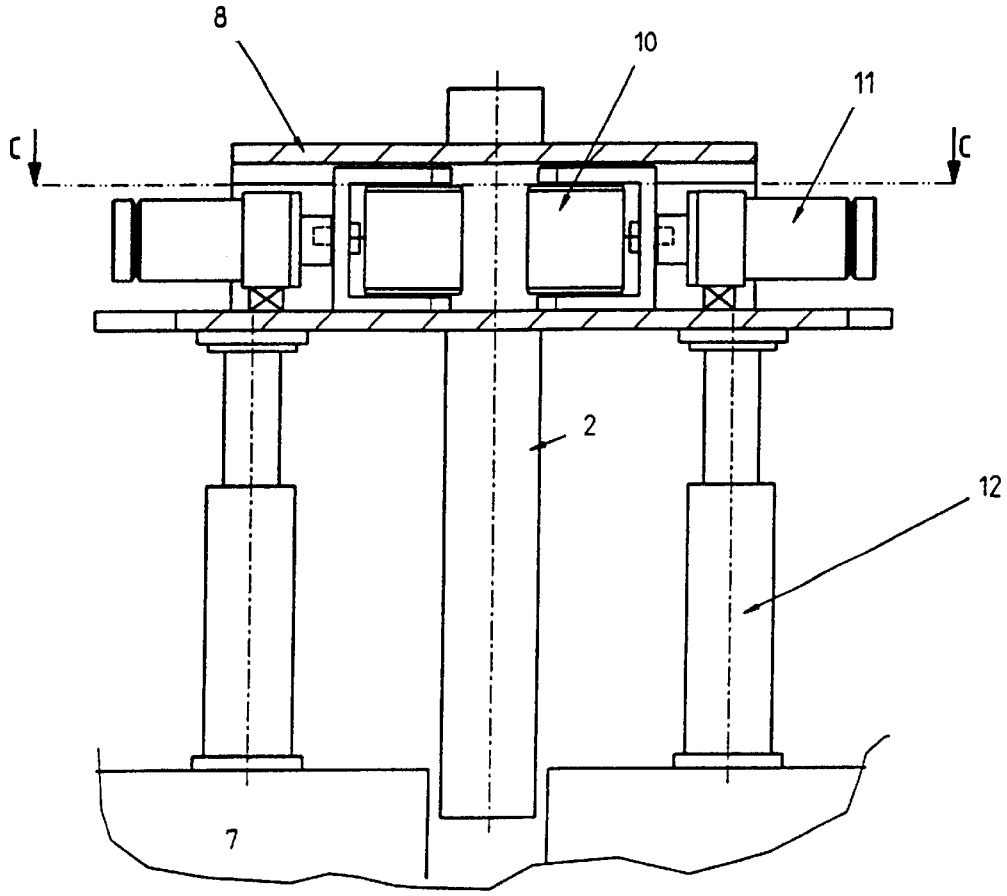

In case the drill string has to be rotated during the intended downhole operation, the embodiment of the frame 7 shown in FIG. 2 is used. The drill string clamp 8 at seabed is fitted with rotating clamping blocks 10. If also the drill string has to be moved up and down to adjust the position of the drill bit in relation to the bottom of the hole, a vertical jacking system 12 is placed between the clamp 8 and the frame 7.

Alternative clamping and jacking systems can be used to the same effect.

Figure 3:
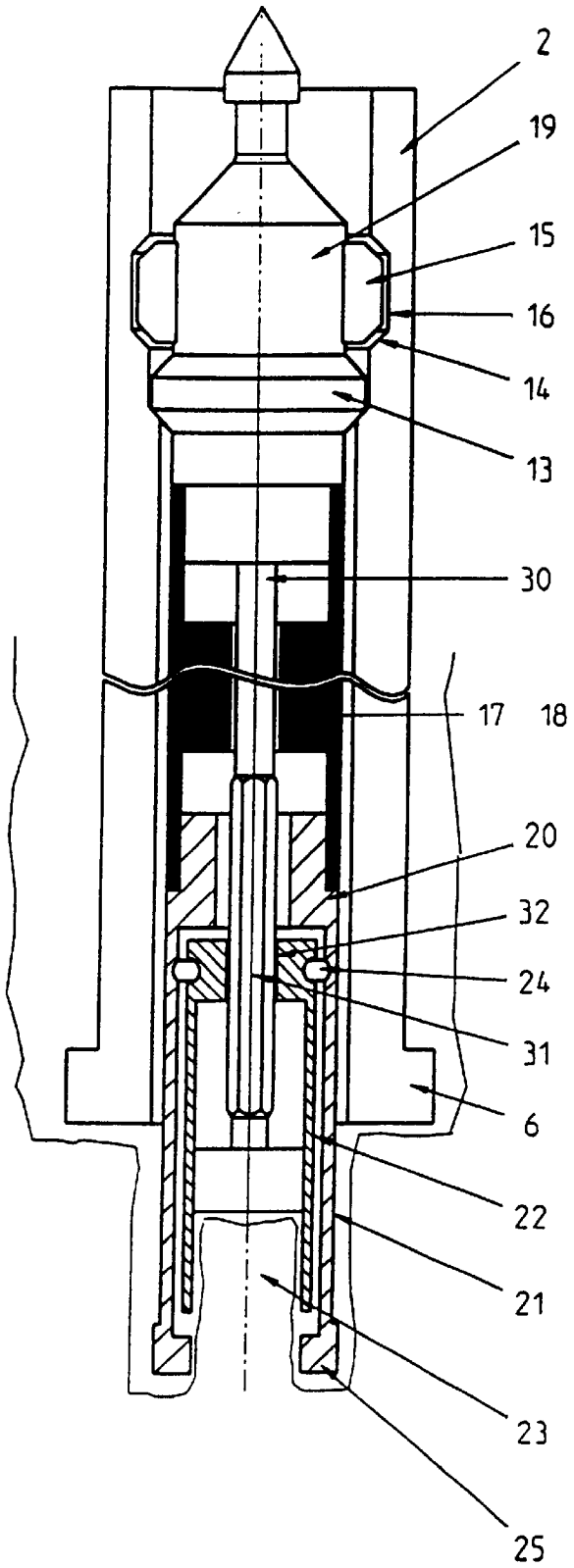
FIG. 3 shows the downhole rotary coring device.

FIG. 3 presents a general outline of a rotary coring device according to the invention, after it is lowered to the bottom end of a drill string 2. Consistent with prior art the coring device consists of a head section 19, a motor 17, a sliding mechanism 18 and a core barrel 20. In the invention the core barrel 20 comprises an outer barrel 21 which is rotated after activation of the motor, and an inner barrel 22 which is connected to the outer barrel with a rotary bearing 24. During the coring process, the coring bit 25 is cutting a core 23 which progressively enters the inner barrel.

The top head section 19 of the coring device has an enlarged section 13 which after landing seats on the landing shoulder 14 provided at the interior of the drill string 2. After landing, dogs 15 are expanded into vertical grooves 16 provided in the drill string to prevent rotation of the head of the coring device when the lower end is rotated by a motor 17.

The motor 17 is used to rotate the outer core barrel and the sliding mechanism 18 is used to move the core barrel downwards during the coring process. These sections are discussed later.

In the practice of rotary coring, it is a requirement that the inner barrel does not rotate during the coring process to protect the core that enters the inner barrel. For this purpose, the inner barrel 22 is connected to the outer barrel 21 by the use of a rotary bearing 24. When the outer barrel 21 is rotated, the rotary bearing 24 allows that the inner barrel 22 is not rotating. The rotary bearing 24 also ensures that the inner barrel 22 moves downward with the outer barrel 21 in unison.

Prior to and during the coring process, the inside of the inner barrel 22 is filled with water. To allow the core to enter the inner barrel 22, the water has to be displaced. During rotary coring drilling fluid is pumped from the surface through the drill string 2. Part of this fluid is directed to the annulus between the outer barrel 21 and inner barrel 22 to cool the coring bit 25 and remove the cuttings. This flow path does not always allow an unobstructed flow and the fluid above the inner barrel 22 can then arrive at a pressure above the ambient pressure. This higher pressure makes drainage of the water from above the core difficult and in extreme cases the water is forced to flow through the core into the formation preventing proper coring.

The coring process can also be frustrated by debris which might be present on the bottom of the hole. Also during the descent of the rotary coring device shown in FIG. 3 through the drill string 2 the inside of the inner barrel 22 is open to the ambient and can be contaminated with foreign material which may float in the fluid in the drill string 2.

The device of the invention prevents rotation of the inner barrel 22, keeps excess fluid pressure away from the top of the core and ensures that the inside of the inner barrel is not contaminated during its descent to the bottom of the hole. For this purpose, the coring device is fitted with a central rod or tube 30 connected to the head section of the device 19. The lower end 31 of the rod is provided with a polygonal cross section which fits through a counter moulded opening 32 in the top of the inner barrel 22. Other constructions are possible connecting the inner barrel in a sliding fashion to the central rod to positively prevent rotation of the inner barrel 22.

Figure 4:
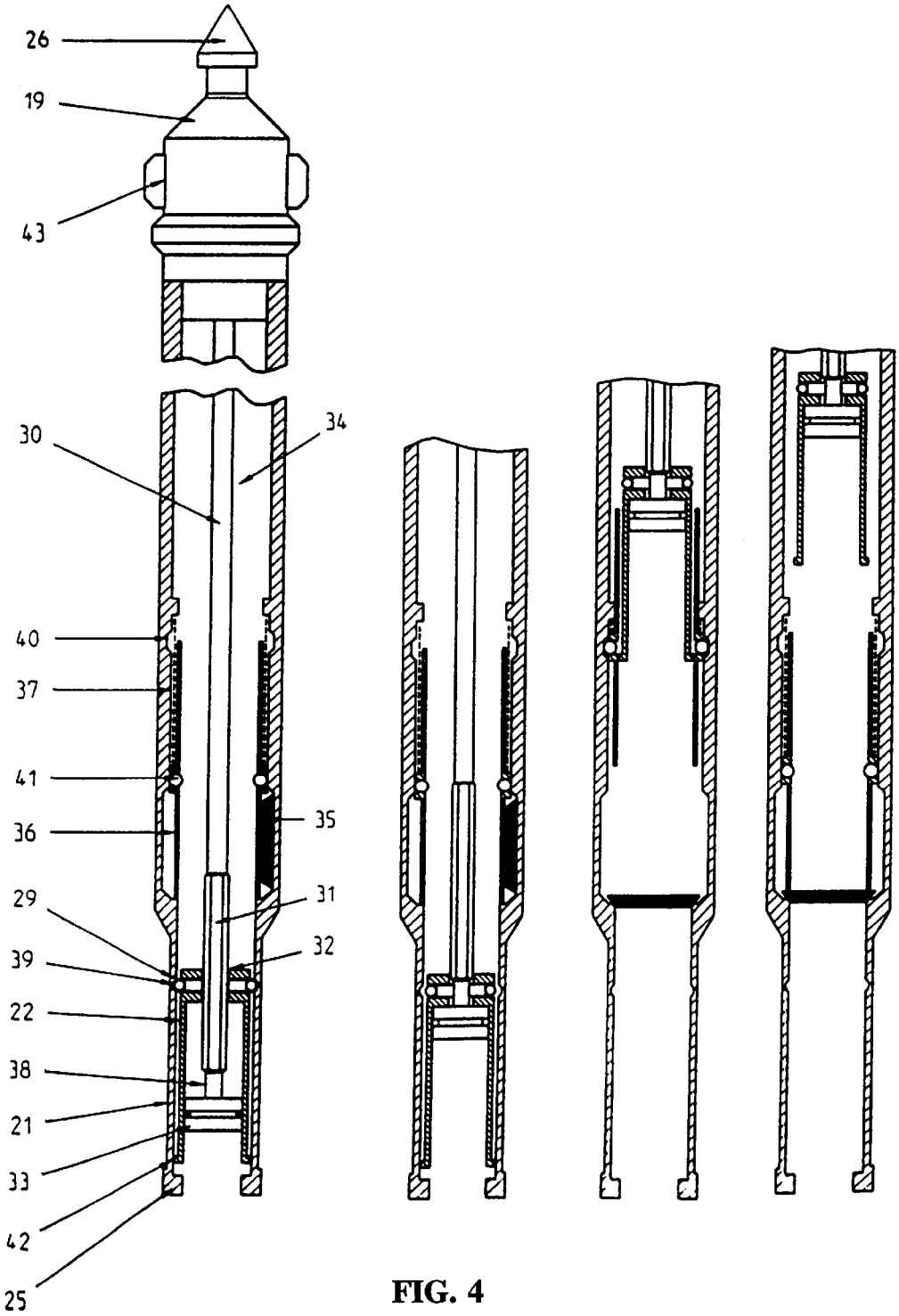
FIG. 4 shows details of the coring device for taking pressurised cores.

Reference is now made to FIG. 4. The rod 30 is fitted with a piston 33 which seals against the inside of the inner barrel 22. This ensures that the core is not subjected to any fluid or pressure present in the area above the piston 33. Before the coring process, the piston 33 is at the lower end 31 of the inner barrel 22 and pushes debris at the bottom of the hole aside during landing of the tool.

A further aspect of the invention relates to the preservation of the downhole fluid pressure around the core during its ascent to the surface. In normal rotary coring operations, the core is brought to the surface such that the pressure around the core is decreasing from the pressure downhole to atmospheric pressure at the surface. Due to this various properties of the core change which frustrate certain examinations. To preserve the downhole pressure, it is common to use a so-called pressure core barrel.

In existing pressure core barrels, sealing of the inner core barrel is effected by the use of a ball valve. This valve is placed at the lower end of the outer core barrel. A consequence of this construction is that the total wall thickness of the core barrel is large and necessitates to cut away much more sediment material than with a core barrel not containing a valve at the bottom end. This negatively affects the quality of the core being cut.

According to one aspect of the invention to secure the quality of the core, a chamber 34 is provided above the core barrel. At the lower end, a valve 35 is positioned. For protection the valve 35 is placed behind a protecting sleeve 36 with lifting balls 41 at the lower end. This sleeve is surrounded by a spring 37. The central rod at its upper end is connected to the fishing head 26. The fishing head is provided with a temporary locking system to the head section 19 following known art to ensure its position during the coring process. When an upward force is exerted on the fishing head with a fishing apparatus of known design, the lock is disengaged and the central rod 30 can be lifted.

The central rod 30 contains a groove 38, the position of which, after a full coring stroke is achieved, coincides with the level of the rotary bearing balls 39 connecting the outer 21 and the inner barrel 22. The inner barrel is fitted with a rim 42 at its lower end. Chamber 34 is provided with a groove 40 which provides space for the lifting balls 41.

Figure 5:
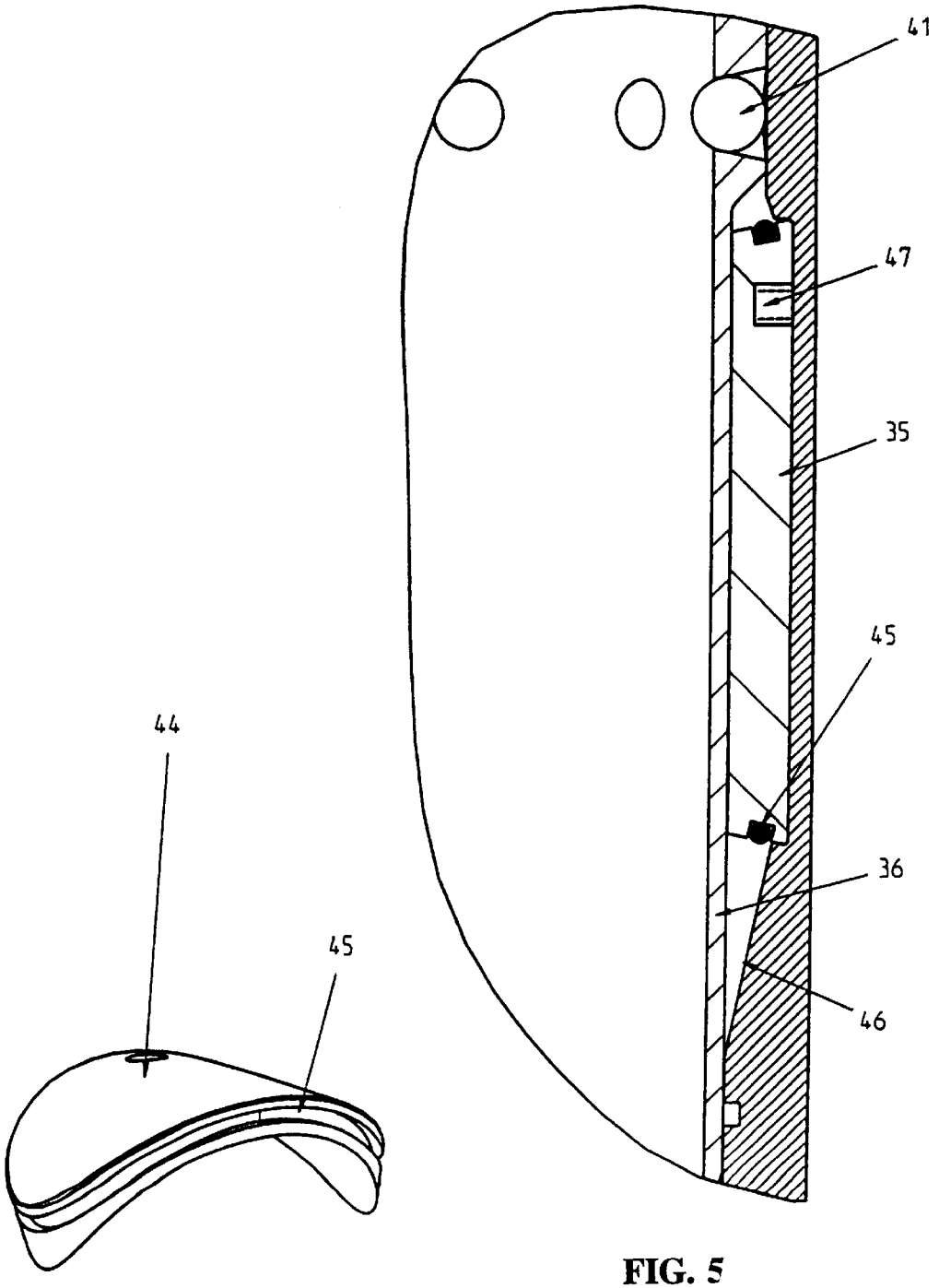
FIG. 5 shows details of system to keep the core under pressure.

The valve 35 can for instance be a ball valve, or a rotatable flat circular plate. In a preferred embodiment shown in FIG. 5, the plate is a curved plate 44 following the curvature of the core barrel with a circumferential seal 45, which after closure cooperates with a conical seat.

The operation is as follows. After the core is cut, the top of the inner barrel 22 is positioned such that the bearing balls 39 can recede into the groove 38 on the central rod 30 undoing the connection between the inner 22 and outer 21 barrel. When now the central rod 30 is lifted by an upward pulling force on the fishing head 26, the inner barrel 22 will move upwards till the rim 42 cooperates with the lifting balls 41. Further upward travel lifts the protection sleeve 36 freeing the valve plate 35 which then is able to close. To assist the closing movement, the valve at the backside is provided with a spring 47 (see FIG. 5). After the sleeve 36 is lifted further, the balls 41 connecting the sleeve 36 to the travelling inner barrel 22 can recede in a groove 40 and the sleeve 36 maintains its position. After the lower edge of the inner barrel 22 is raised above the position of the lifting balls 41, the sleeve 36 travels downwards assisted by the action of a spring 37 such that it comes to rest on the backside of the valve plate 35 and helps to keep it in closed position.

Alternative methods to lift the inner rod can be used such as hydraulic actuators.

The advantage of this construction is that the valve 35 is not placed in the actual core barrel but above this barrel and does not need to be embedded in the formation being cored. Furthermore, the valve 35 consists of a curved plate such that the space taken by the valve 35 in open position is minimised such that the ratio between the diameter of the core and the outside diameter of the tool is larger than in existing tools.

Referring now to FIG. 3, it is remarked that in rotary coring devices the rotation is effected by a motor 17 that is placed on top of the core barrel and that is driven by a fluid pumped from the surface through the drill string 2. The reaction to the torque generated by the motor 17 is provided by locking the stationary part of the motor to the drill string 2.

Existing coring devices use a downhole motor 17 in which the rotor and stator are axially coupled through axial and radial bearings. To allow downward movement of the core barrel 20 during the coring process, a separate sliding mechanism unit 18 is placed between the motor 17 and the core barrel 20 or between motor 17 and the head 19 of the coring device. Another required feature is a mechanism to exert a downward thrust on the coring bit. Pressure of the fluids flowing through the sliding/thrusting mechanism cause a downward thrust on the coring bit 25 required to effectuate the cutting action.

In prior art the assembly of the motor, the sliding and the thrusting mechanism lead to a complicated assembly. The invention simplifies matters.

In the invention the rotor and stator are allowed to move longitudinally in relation to one another. Furthermore in the invention the motor 17 and the sliding/thrusting mechanism are combined as explained with reference to FIG. 6.

Figure 6:
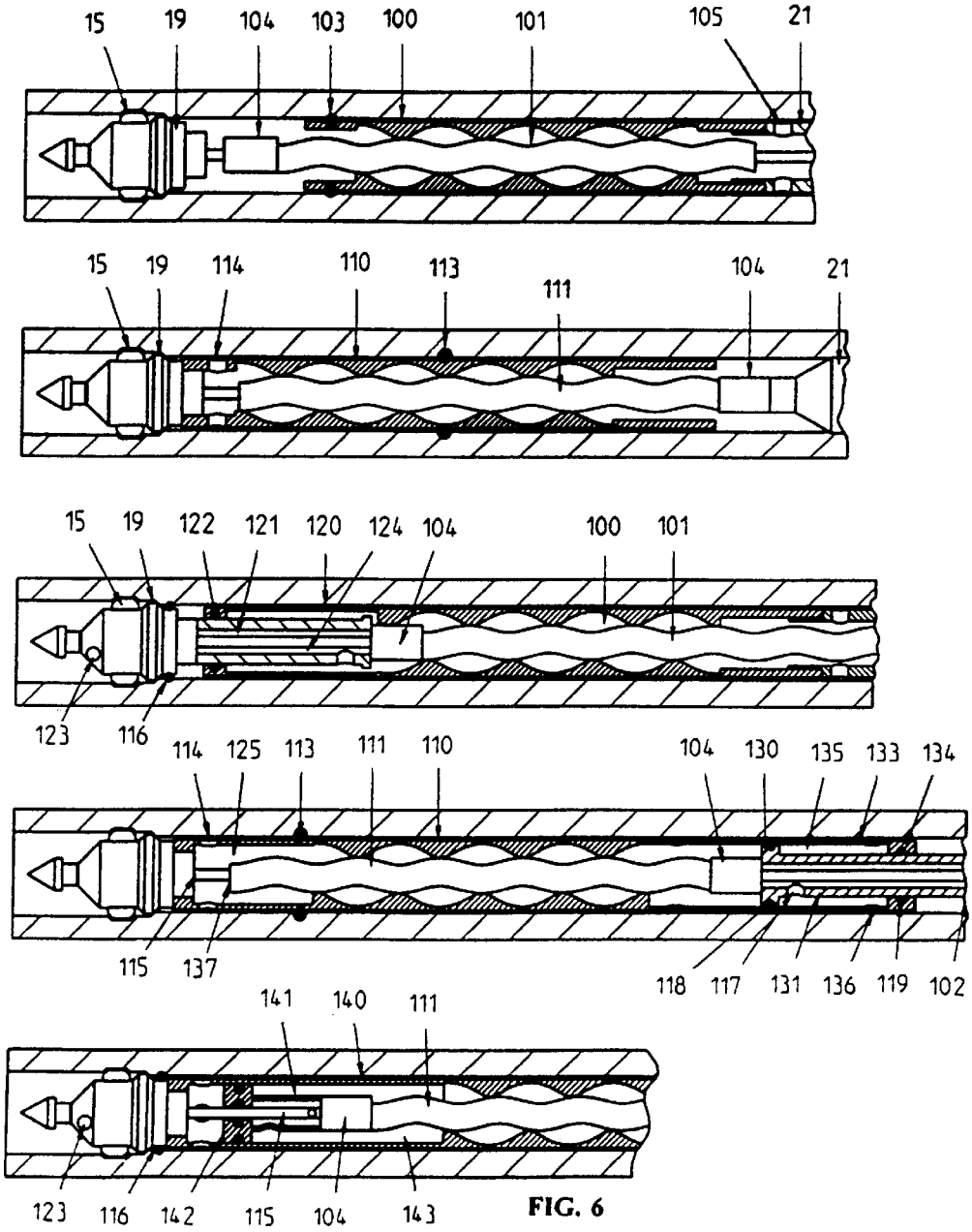
FIG. 6 shows some embodiments of the motor and thruster configuration of the rotary coring device.

FIG. 6.1 shows a first embodiment. The motor is a motor of the helical screw type which rotates when a fluid is forced through the opening between the outer motor housing and the inner motor part. In this embodiment, the outer 100 and inner motor part 101 can move axially in respect to each other. The outer motor housing 100 is connected to the outer core barrel 21 and seals 103 against the inside of the drill pipe. The inner motor part is connected to the head of the device such that it is prevented from rotation by the locking dogs 15. The connection between the inner motor part 101 and the head 19 contains a flex shaft 104 of known construction allowing the inner motor part to rotate inside the outer housing as is required in a helical screw motor.

When a fluid is pumped down the drill string, it will be forced to flow through the motor causing a rotary action. The flow will exit the motor through hole 105 into the non pressurised space in the drill pipe. Due to the motor construction, the pressure at the outlet of the motor is considerably lower than at the top of the motor. The fluid pressure above the outer housing will exert a downward thrust on top of the outer housing forcing the outer housing and the outer core barrel connected to it downward creating a thrust on the coring bit.

To limit the stroking out of the outer housing, the piston system as shown in FIG. 3 can be used or other extension on the inner motor part or central rod. During descent and landing, the outer motor housing can be coupled to the head 19 using pressure activated release mechanisms of known art.

FIG. 6.2 shows a second embodiment wherein the outer housing 110 is connected to the head 19 and the inner motor part 111 is connected to the outer core barrel 21 via a flex shaft 104. The outer house is sealed 113 against the inside of the drill pipe.

For certain rock formations, the downward thrust needs to be regulated in function of the type of formation, and of the torque required to rotate the coring bit. For certain formations, the downward thrust created by the fluid pressure on the axially moving part needs to be mitigated. In other formations it is advantageous if the downward thrust is inversely related to the torque. For this another embodiment as shown in FIGS. 6.3 or 6.4 or 6.5 can be used.

FIG. 6.3 shows a further development of the motor shown in FIG. 6.1. The motor housing 110 is extended upwards with a cylindrical pipe 120. The connection between the head 19 and the inner motor part 101 is extended with a cylindrical part 121. The part 121 is provided with a sealing element 122 at its top end such that a closed chamber 124 is formed. The drill pipe is sealed at the position of the head 19 and fluid is channelled through channels 123 in the head to this chamber 124. When fluid is supplied, its pressure will act downwards against the motor part creating a downward thrust and it will act upward against the sealing element 122 offsetting part or the whole of the downward thrust.

In the embodiment shown in FIG. 6.4, the outer housing of the motor 110 is connected at its top to the head 19 of the device. The inner motor part 111 is at its lower end connected to the core barrel 101 via flex shaft 104. The outer housing has a hole 114 at the upper end and contains a seal 113 sealing against the interior of the drill string. Between the flex shaft 104 and the outer barrel 102, a chamber 135 is created by a piston 130 fitted on the extended shaft 131 and the extension cylinder 133 of the outer housing with a cylinder head 134 at its lower end. Fluid is channelled from chamber 125 through the interior of the inner motor part and exiting in the foresaid chamber 135. Chamber 135 is provided with a hole 136 towards the outside. This hole acts as a choke providing a resistance to the flow in relation to the speed of downward movement of the piston 130 in relation to the cylinder 133, causing an elevated pressure in chamber 135. This pressure causes an upward thrust on the piston 130. In this way the assembly 130 to 136 acts as a reverse thruster.

In some cases, it is advantageous that the reverse thruster only starts its action after a threshold pressure in chamber 125 has been reached. For this a pressure drop valve 137 is placed in the channel from chamber 125 to chamber 135.

By selecting the appropriate specifications for the pressure drop valve 137 and the opening 136, the pressure in the buffer chamber 135 can be varied in function of pressure above the motor and the speed of advancement of the core barrel such that the thrust created by the pressure difference over the motor is counteracted by the force created in the buffer chamber.

FIG. 6.5 shows yet another method of creating a reversed thrust as a further development of the embodiment shown in FIG. 6.2. For this the outer housing is extended with a cylinder pipe 140. The inner motor part is extended upwards with a rod 141 with a piston head 12 at its top. This piston seals against the extension 140 created a closed chamber 143. Fluid pressure driving the motor will exert a downward thrust on the inner part which is ten offset partly or in whole by the upward thrust against piston 142.

The embodiments shown in FIGS. 6.3 to 6.5 can be used separately or in combination. By selecting the right dimensions of the buffer chambers, pressure drop valves and chokes any relation between thrust, motor torque and speed of advancement can be created.

Other fluid channels are provided to lead the fluid through the central rod 115 to provide flushing to the coring bit. Also the fluid can flow through the annulus between the inner motor part and the central rod for purposed explained above.

What is claimed is:

1. A downhole rotary coring device placeable in a drill string and comprising a head section, a motor, and a core barrel having an outer barrel connected to the motor and an inner barrel placed inside the outer barrel, wherein the motor is of the helical screw type comprising a housing and a helically shaped axis positioned in the housing, wherein the housing is used as a rotor which is connected to the outer barrel and the helically shaped axis is used as a stator which is connected to the head section, and wherein the axis is movable longitudinally with respect to the housing.

2. Device according to claim 1, wherein the housing is fixed to the outer barrel and the axis is coupled to the head section via a flex shaft.

3. Device according to claim 2, wherein an intermediate part is provided between the head section and the housing and helically shaped axis respectively, constituted as an assembly of a cylindrical pipe connected to the housing on the side facing the head section, and means fitted in the cylindrical pipe for connecting the head section to the flex shaft, whereby the cylindrical pipe and said means define a chamber having a seal on said side of the housing facing the head section.

4. Device according to claim 1, wherein the axis is connected to the outer barrel via a flex shaft, and the housing is fixed to the head section.

5. Device according to claim 4, wherein an intermediate part is provided between the flex shaft and the outer barrel constituted as an assembly of an extension cylinder mounted on the housing and means fitted in the extension cylinder connecting the flex shaft to the outer barrel, whereby the extension cylinder and said means define a chamber, which chamber is provided with an opening in an outer wall of the extension cylinder.

6. Device according to claim 1, wherein a cylinder pipe connects the housing to the head section, and on the side facing said head section the helical axis is provided with an assembly of a flex shaft and a rod with a piston head at an extremity of said rod, whereby said piston head is in sealed relation to the cylinder pipe thereby defining a chamber.

7. Device according to claim 1, wherein a rotary bearing connects the inner barrel to the outer barrel, and that the inner barrel is slidably connected to a rod that is fixed to the head section, which rod cooperates with a passage in the inner barrel, whereby the said rod and passage are shaped so as to prevent said inner barrel to rotate.

8. Device according to claim 1, wherein on top of the core barrel a chamber is provided for inner barrel, which chamber is closable with a valve.

9. Device according to claim 8, wherein in the fully open position the valve is positioned behind a protective sleeve that is in an initial position.

10. Device according to claim 8 wherein the valve is a curved plate.

11. Device according to claim 10, wherein the curved plate has a circumferential seal and cooperates in its closed position with a conical seat.

12. Device according to claim 9, wherein the sleeve is provided with lifting balls, and that the inner barrel has an outwardly extending rim suited to cooperate with said balls for lifting the sleeve when the inner barrel is moved into the chamber.

13. Device according to claim 8, wherein the chamber is provided with a groove for receiving the lifting balls once the sleeve is placed in a lifted position so as to allow the inner barrel to continue its lifting motion whilst releasing the sleeve to return to its initial position.

14. Device according to claim 7, wherein the rod is provided with a piston that is positioned within the inner barrel, and that adjacent to the pistol the rod is having a groove portion for receipt of rotary bearing balls, forming part of the rotary bearing connecting the inner barrel to the outer barrel.

15. Rotary coring system comprising drill string and a downhole rotary coring device according to claim 1, whereby the drill string is suspended from a vessel floating on sea, wherein a frame is positioned and fixed on the sea bed, which is provided with a pipe clamp for the drill string.

16. Rotary coring system according to claim 15, wherein the frame is fixed by gravity forces.

17. Rotary coring system according to claim 15, wherein the pipe clamp is actuable by hydraulic jacks that are mounted on the frame.

18. Rotary coring system according to claim 15, wherein the pipe clamp has rotatable clamping blocks that are movable to and fro the drill string.

19. Rotary coring system according to claim 15, wherein the frame has a vertical jacking system for moving the pipe clamp vertically.

* * * * *